US008267000B1

(12) United States Patent
Larson et al.

(10) Patent No.: US 8,267,000 B1
(45) Date of Patent: Sep. 18, 2012

(54) MUNITIONS ENDGAME GEOMETRY FOR OPTIMAL LETHALITY SYSTEM

(75) Inventors: Charles Allen Larson, Fort Walton Beach, FL (US); Kevin Thomas McArdle, Shalimar, FL (US)

(73) Assignee: Service Engineering Company, Belcamp, MD (US)

( * ) Notice: Subject to any disclaimer, the term of this patent is extended or adjusted under 35 U.S.C. 154(b) by 1149 days.

(21) Appl. No.: 12/154,763

(22) Filed: May 27, 2008

Related U.S. Application Data

(60) Provisional application No. 60/940,234, filed on May 25, 2007.

(51) Int. Cl.
*F42C 17/00* (2006.01)

(52) U.S. Cl. ..... 89/6.5; 102/270; 102/265; 102/215; 89/1.11

(58) Field of Classification Search ..... 102/206, 102/215, 265, 270; 89/6.5, 6, 1.11
See application file for complete search history.

(56) References Cited

U.S. PATENT DOCUMENTS

| | | | | |
|---|---|---|---|---|
| 7,600,475 | B1 * | 10/2009 | Friedberg et al. | 102/265 |
| 7,631,833 | B1 * | 12/2009 | Ghaleb et al. | 244/3.15 |
| 7,698,983 | B1 * | 4/2010 | Pinto et al. | 89/6.5 |
| 2007/0157843 | A1 * | 7/2007 | Roemerman et al. | 102/385 |
| 2010/0147141 | A1 * | 6/2010 | Magnan et al. | 89/6.5 |

* cited by examiner

*Primary Examiner* — J. Woodrow Eldred
(74) *Attorney, Agent, or Firm* — Peter Loffler

(57) ABSTRACT

A system that guides an airborne weapon toward a target, in order for the weapon to fuze at the target, so as to increase the probability of kill of the target. The system uses a lethality database that lists the various vulnerabilities for each target so that the weapon may fuze at a point that achieves maximum exploitation of the vulnerabilities. The system continually updates during weapon fly out in order to continually update the best achievable aim point for the weapon based on the changing encounter geometry between weapon and target.

18 Claims, 7 Drawing Sheets

Perpendicular to
munition view

Perpendicular to
munition view

MUNITIONS ENDGAME GEOMETRY FOR OPTIMAL LETHALITY SYSTEM

This application claims the benefit of provisional patent application No. 60/940,234 filed on May 25, 2007, which provisional application is incorporated herein by reference.

STATEMENT REGARDING FEDERALLY SPONSORED RESEARCH OR DEVELOPMENT

This material is based upon work supported by the United States Air Force under Contract No. FA8651-07-C-0096.

Distribution B.
Distribution authorized to US Government agencies only, contains proprietary information, 29 Jan., 2007. Refer other requests for this document to AFRL/MNMF, Eglin AFB Florida32542-6810.
Warning
This document contains technical data whose export is restricted by the Arms Export Control Act (Title 22, U.S.C. 2751 et seq) or the Export Administration Act of 1979, as amended, Title 50, U.S.C., App. 2401 et seq. Violation of these export-control laws is subject to severe criminal penalties. Dissemination of this document is controlled under DoD Directive

BACKGROUND OF THE INVENTION

1. Field of the Invention

The present invention relates to an airborne munitions asset onboard system that automatically calculates optimal detonation points, munitions orientation, velocity, and final trajectory for the asset in order to achieve the optimal endgame conditions for the munitions in order to maximize the probability of kill of the target 2. Background of the Prior Art Current weapons are typically aimed or guided to the center of surface mobile targets. If the weapon overmatches the target such center aiming is sufficient to neutralize the target. If the incoming missile has sufficient detonation power, detonation of the missile anywhere near the target may destroy the target. On the modern battlefield, there is a trend toward the use of smaller weapons in order to destroy a given target. This trend is occurring for several reasons. Modern day battlefield commanders strive to minimize collateral damage including civilian deaths, occasioned by deployed weapons systems. Collateral damage minimization is especially difficult whenever a weapon is being prosecuted in an urban setting. Additionally, the use of smaller weapons allows for a greater number of weapons to be carried by a given delivery vehicle so that such a vehicle may destroy relatively more targets prior to the need to rearm. Furthermore, desired cost savings, both in manufacture and transport of the weapon, dictate a relatively smaller weapon for a given target.

The problem with using smaller weapons lies in the fact that many mobile targets may be relatively heavily armored proximate the center or may have vulnerable critical components located distant from the center. A relatively small weapon relative to the target that detonates at the aimed center of the target, may not place enough fragments, blast effects or munitions debris on the target's critical components to achieve a kill. FIG. 5*a* illustrates a typical weapon aimed at centroid of the target. Although such aiming minimizes miss distance, the resulting detonation attacks the target at a protected area so that a kill is not achieved. Instead, the warhead's detonation position must be chosen to insure the fragments, blast effects and/or munitions debris impact on the critical components. The detonation location that best satisfies this requirement will vary with target and may be anywhere in the near vicinity of the target. FIG. 5*b* illustrates a weapon that has its guidance optimized in order to fuze the weapon at a point that attacks the vulnerable components of the target and increases the probability of kill of the target.

To address this problem, many weapons are guided to a desired critical point of the target by a forward observation officer who is located in a line of sight position with respect to the target. The forward observation officer guides the weapon to a desired point on the target in order to increase the probability of kill. While this method of weapons targeting typically increases the probability of kill by advantageously positioning the strike of the weapon, the method requires the use of an additional operator. Not only is the forward observation officer in harm's way, oftentimes such positioning of an observation officer may not be possible, especially at the commencement of hostilities in a given location.

What is needed is a weapon that can autonomously determine the vulnerabilities of a particular target so as to be able to determine the position (which may or not be impact), the orientation, and the velocity at detonation in order to maximize the probability of kill in order to allow the deployment of the smallest possible weapon for a given target. Such a weapon must be able to continually update its endgame conditions based upon the changing dynamics of both the target and the weapon itself Ideally, such a control system used by the weapon to achieve its goals should be relatively small both in weight and volume/space occupied so as not to have undue impact on the overall physical architecture of the weapon.

SUMMARY OF THE INVENTION

The munitions endgame geometry for optimal lethality system of the present invention addresses the aforementioned needs in the art by providing an onboard system for a weapon that allows the weapon, based on the determination of target type, the target class or the target subclass, to determine the vulnerabilities of the target in order to allow the weapon to achieve a desired position, orientation, and velocity at detonation so as to increase the probability of kill by the weapon of the target. The munitions endgame geometry for optimal lethality system continually updates during fly out in order to accommodate velocity and position changes of the target as well as the flight dynamics of the weapon. For example, should a desired azimuth and elevation angle at detonation no longer be achievable due to change of position of the target and the proximity of the weapon to the target, the munitions endgame geometry for optimal lethality system recalculates in order to determine the optimal endgame geometry that is achievable under the current real-time conditions. Additionally, if the recalculated endgame geometry that is achievable is insufficient to achieve a high probability of kill, the munitions endgame geometry for optimal lethality system is able to guide the weapon to a revised target should the munitions endgame geometry for optimal lethality system determine that the achievable endgame geometry for the revised target can result in a higher probability of kill. Due to the incredibly small size of modern electronic circuits, and such circuits' abilities to effect incredibly fast computational speeds, the munitions endgame geometry for optimal lethality system does not occupy undue space or weight within the overall weapon. In fact, the entire MEGOL system can be implemented within an existing munition's operational flight program and memory, in some cases requiring no additional hardware or weight.

The munitions endgame geometry for optimal lethality system allows a battlefield commander to deploy small autonomous weapons able to independently prosecute a wider target set, and capable of achieving a high probability of kill, thereby reducing the potential for collateral damage and non-combatant deaths as well as allowing the commander to stock a relatively high number of weapons onto a given delivery vehicle.

The munitions endgame geometry for optimal lethality system is comprised of a guided weapon that has a sensor system, a guidance system, a fuze system for detonating a warhead, and a body having flight controls. A controller is in communication with the guidance system, the sensor system, and the fuze system. A lethality database is populated with a plurality of entries such that each entry has a target entry, a plurality of vulnerabilities associated with the target entry, and a probability of kill quantity associated with each vulnerability. The weapon is launched and the sensor system identifies target and a first position coordinate set (position of the target and position of the weapon) and communicates the target identified and the first position coordinate set to the controller. The controller queries the lethality database and selects a respective target entry that corresponds with the target and retrieves the plurality of vulnerabilities and each associated probability of kill quantity. The controller determines which of respective one of the plurality of vulnerabilities having the highest probability of kill quantity can be attacked. The controller calculate an optimal attack azimuth and elevation angle based on the first coordinate set and communicates the attack azimuth and elevation angle to the guidance system which then articulates the flight controls to achieve the attack azimuth and elevation angle. The controller also calculates an optimal burst height based on the first coordinate set and communicates the burst height to the fuze system in order to detonate at the first burst height. Each target entry may be a specific target type, a class of a target type, or a subclass of a target type. The controller calculate a way point whereto the weapon flies on the way to the attack azimuth and elevation angle and the burst height such that the weapon switches to a proportional navigation system upon reaching the way point. The system continually updates so that the sensor system identifies a second coordinate set subsequent to the identification of the first coordinate set and has the controller calculate a new optimal attack azimuth and elevation angle and elevation angle which is communicated to the guidance system and a new optimal burst height which is communicated to the fuze system. The controller alters a geometry of the warhead if the warhead is so shapeable. The sensor system selects a new target whenever the respective one of the plurality of vulnerabilities that is selected has a probability of kill quantity that is below a predetermined threshold and a better target solution is available.

The vulnerabilities for each target are generally precomputed for a three dimensional grid at various representative heights, azimuth and elevation angles and encounter velocities using standard effectiveness codes (such as the Advanced Joint Effectiveness Model) for each class, subclass, and specific target in the weapon's target set. To ensure optimal effectiveness, this initial vulnerability dataset is modified using standard statistical methods to account for various weapon delivery accuracies such as Target Location Error, and Circular Error Probable. In doing so, each 3D coordinate in the weapon's target vulnerability dataset represents not the specific result of achieving a particular endgame, but it represents the predicted weapon effectiveness associated with aiming and guiding toward a selected point regardless of whether the weapon achieves a particular coordinate.

BRIEF DESCRIPTION OF THE DRAWINGS

Similar reference numerals refer to similar parts throughout the several views of the drawings.

DESCRIPTION OF THE PREFERRED EMBODIMENT

Figure 1:
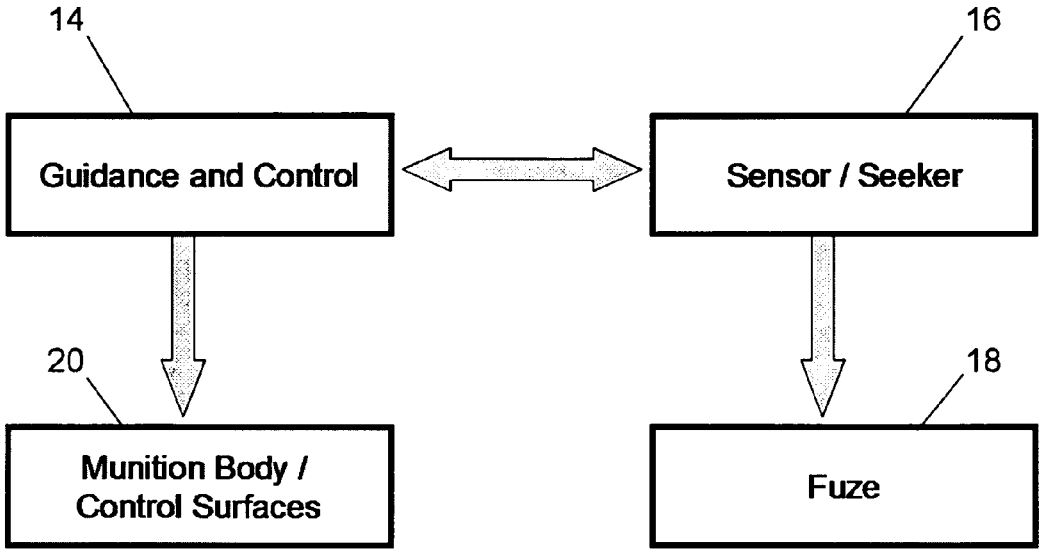
FIG. 1 is a schematic of a control system of a typical guided weapon.

Referring now to the drawings, it is seen that the munitions endgame geometry for optimal lethality system (MEGOL) of the present invention, generally denoted by reference numeral 10, is comprised of a system that is integrated into the on-board control circuitry of an airborne munition 12 of any appropriate type, including air-to-surface, air-to-air, surface-to-air, surface-to-surface, anit-ship, and anti-satellite munitions. As seen in FIG. 1, a typical modern day "smart" weapon has four major components that are used for the desired delivery of the weapon 12, the guidance system 14, the sensor system 16, the fuze system 18, and the flight controls 20 that control fly out operations of the weapon 12. These systems operate to bring the weapon 12 to a moving target 22 and attempt to deliver the weapon to the center of the target 22 with the munition on board the weapon 12 being fuzed in some preprogrammed fashion (which may or not be impact, or timed or computed via a separate guidance integrated fuzing algorithm). During weapon 12 flight, the sensor system 16 acquires the target 22 and based upon its known position, calculates the position of the target 22 relative to the weapon 12. This information is passed to the guidance system 14 so that the guidance system 14 can calculate a flight plan in order to guide the weapon 12 to the target 22, such flight plan being passed to the flight controls 20 in order for the flight controls 20 to physically guide the weapon 12 to the target 22. Once the sensor system 16 determines that the weapon 12 is at the desired position with respect to the target 22 for fuzing, such information is passed to the fuze system 18 in order to detonate the explosives on board the weapon 12. The sensor system 16 continually updates as the target 22 and the weapon itself 12 each change position over time, which updates are passed to the guidance system 14 in order for the guidance system 14 to update the flight plan and alter he flight controls 20 as necessary. Many such modern weapon systems are capable of delivering the weapon 12 to the target 22 with incredible accuracy. However, as discussed previously, the weapons 12 are designed to be aimed at the center of the target 22 which may prove sufficient if the weapon 12 over matches the target 22, yet may not achieve a kill should the weapon 12 be sized for the target 22 and the weapon 12 fails to destroy critical components of the target 22, which critical components are located distant from the target's center.

Figure 2:
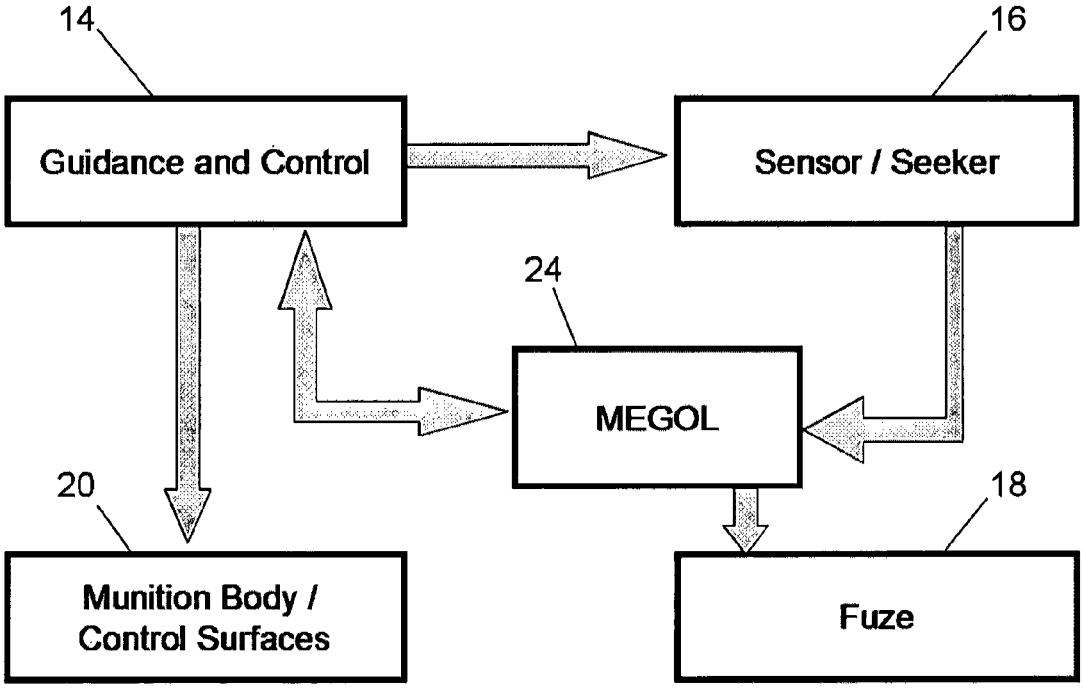
FIG. 2 is a schematic of a control system of a guided weapon having the munitions endgame geometry for optimal lethality system of the present invention incorporated therein

As seen in FIG. 2, the munitions endgame geometry for optimal lethality system 10 is inserted into the overall weapon system in order to optimize the lethality of the weapon 12 for a given target. The munitions endgame geometry for optimal lethality system 10 identifies the target 22, either with specificity—small pickup truck with machine gun mounted in bed—or with generality—wheeled land vehicle and based on this identification, determines the vulnerabilities of the target 22 so as to allow the weapon 12 to have the position, orientation, and velocity at fuze that gives the highest probability of kill for the target 22.

Figure 3:
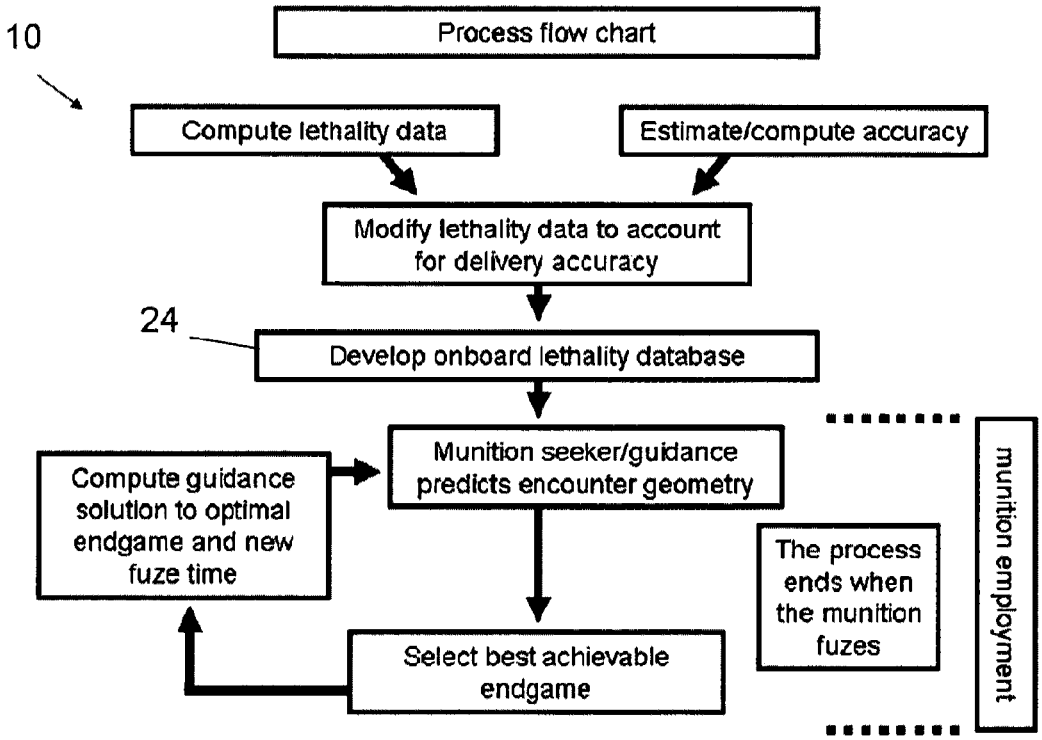
FIG. 3 is a process flow chart of the munitions endgame geometry for optimal lethality system.
Figure 4:
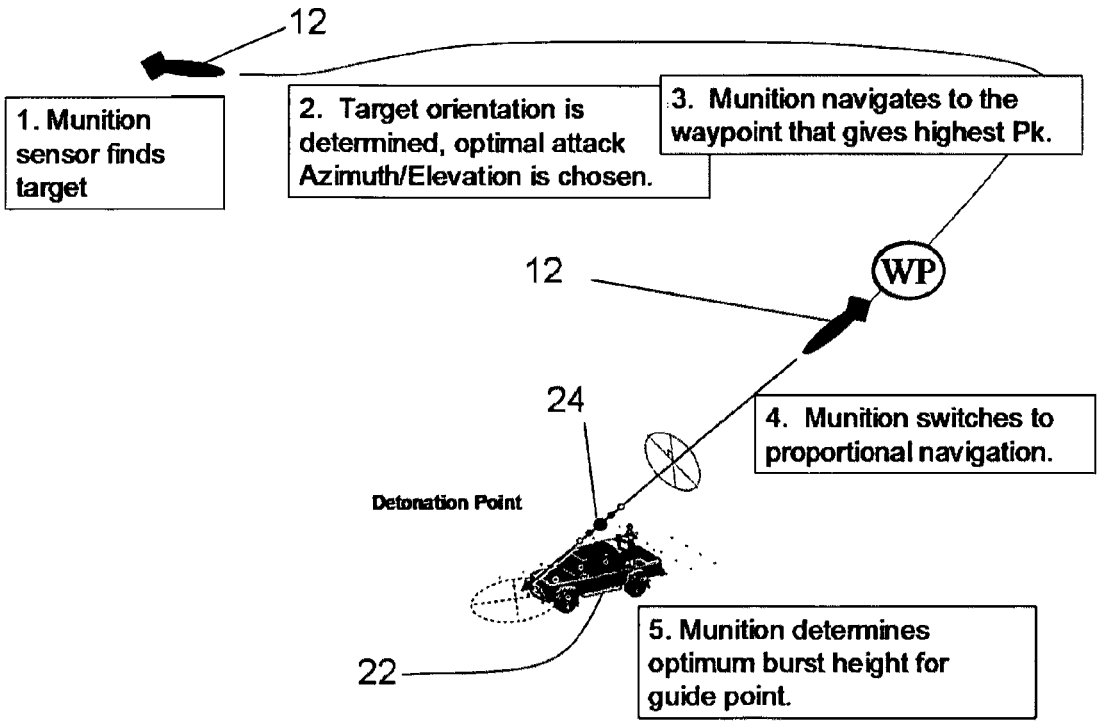
FIG. 4 is an environmental view of a weapon utilizing the munitions endgame geometry for optimal lethality system.
Figure 5A:
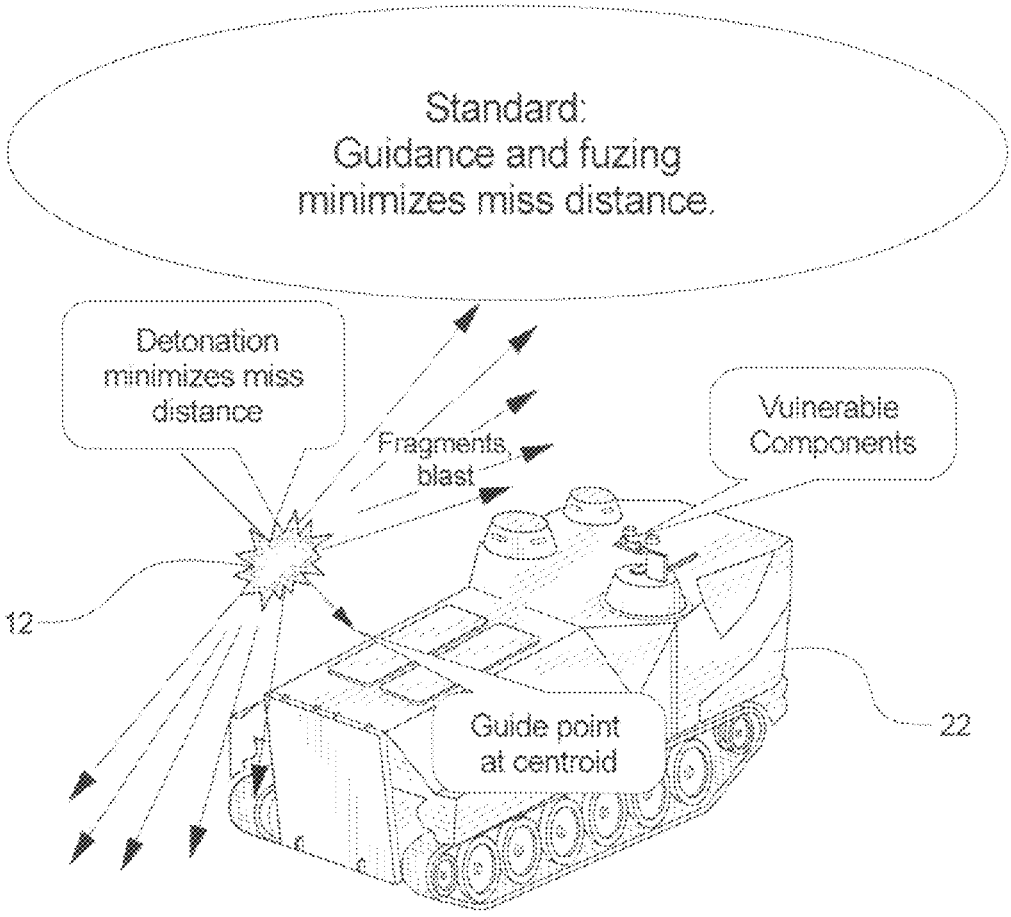
FIG. 5*a* is a perspective view of a target under attack by a weapon aimed at the center of the target.
Figure 5B:
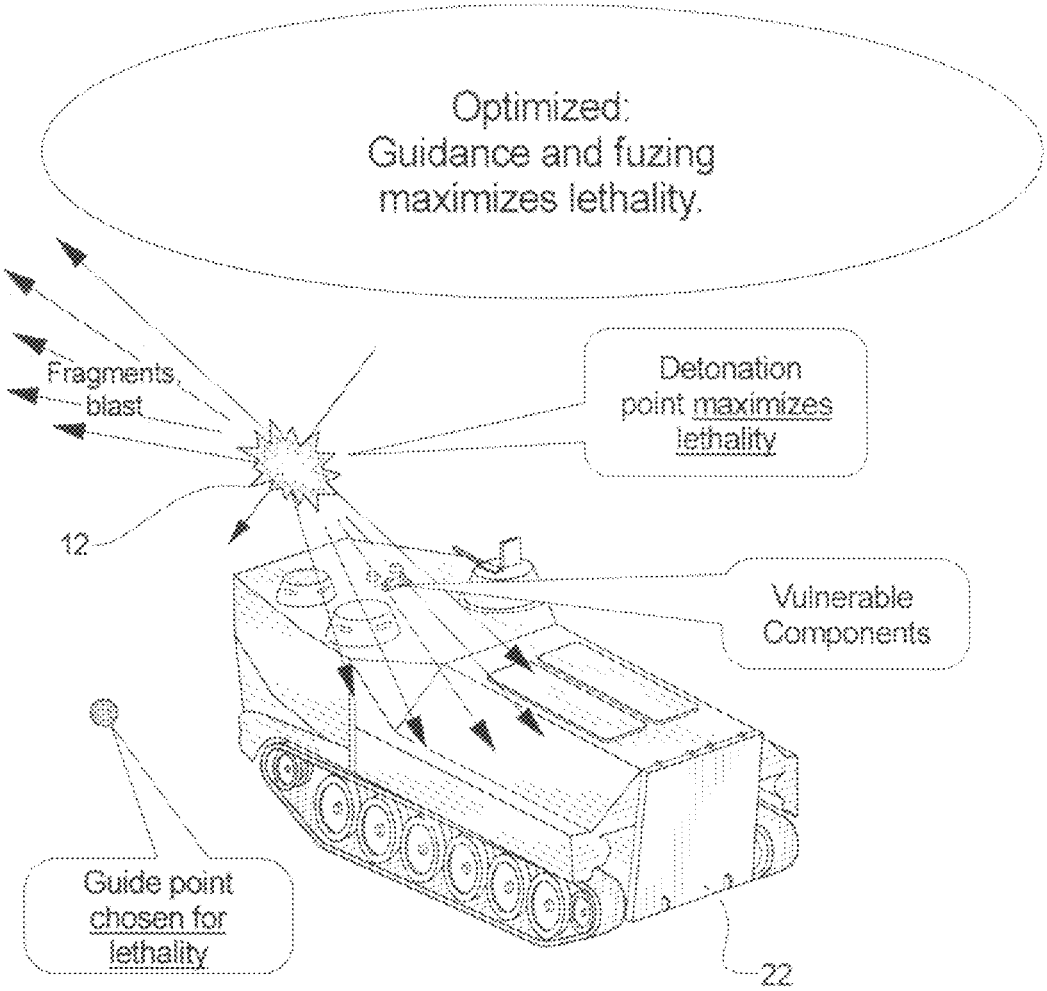
FIG. 5*b* is a perspective view of the target under attack by a weapon under control of the munitions endgame geometry for optimal lethality system.
Figure 6:
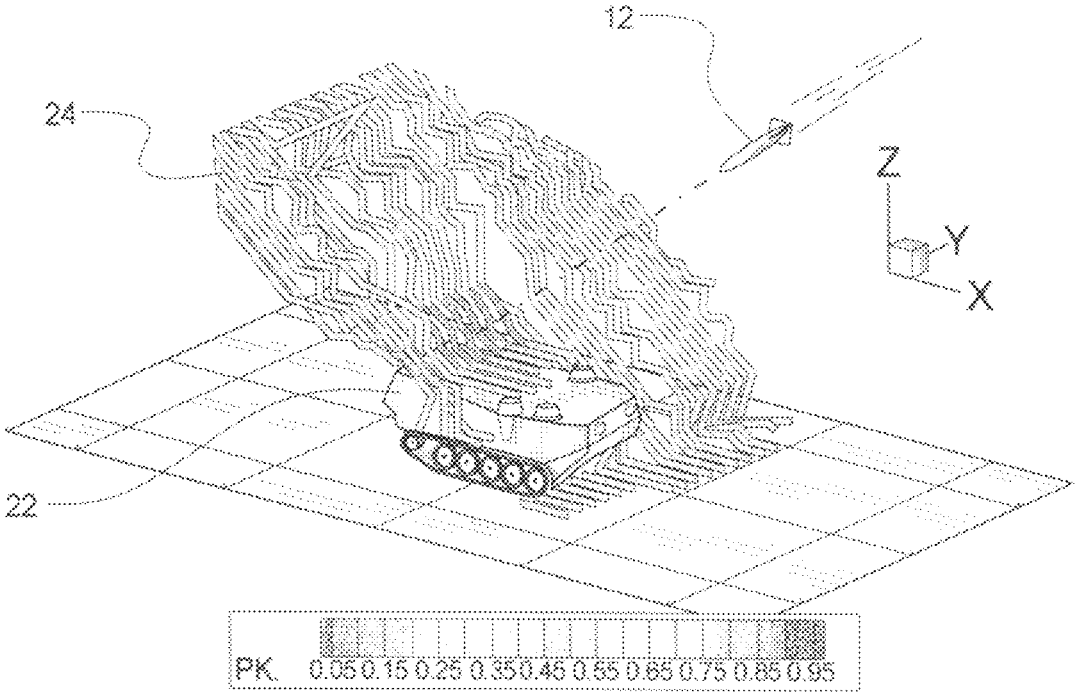
FIG. 6 is a depiction of a lethality dataset for one weapon-target pair for one azimuth and elevation combination.

As seen in FIG. 3, at the heart of the munitions endgame geometry for optimal lethality system 10 is an onboard lethality database 24. This database 24 is developed using knowledge of the structures of various targets 22 and the various vulnerabilities of each target 22. Multiple sets of vulnerabilities can be calculated for each target: for example, firepower kill, mobility kill, firepower and mobility kill, personnel kill, and non-personnel kill in order to account for the specific military and political objectives governing the mission. The database 24 is populated with the vulnerabilities for each known target 22 that may be anticipated on the battlefield. The lethality database 24 is also populated with vulnerabilities for classes of targets 22, for example wheeled land vehicle. As various munition types exploit target 22 vulnerabilities in a different manner, and as each munition 12 has a different degree of accuracy and kill mechanisms, the lethality database 24 is transformed for each specific weapon 12 upon which the munitions endgame geometry for optimal lethality system 10 resides.

In operation, munitions endgame geometry for optimal lethality system 10 is integrated into the overall control system of the weapon. The lethality database 24 is loaded onto the weapon 12 either prior to launch or in-flight. Once the sensor system 14 of the weapon 12 acquires a target 22, the system 14 determines what the type of target is. The sensor attempts to define the target type with as much precision as possible in order to determine the vulnerabilities for the target 22 with as much precision as possible. The target type, along with time and space between target 22 and weapon 12 data, is relayed to the munitions endgame geometry for optimal lethality system 10 by the sensor system 14 wherein the munitions endgame geometry for optimal lethality system 10 retrieves the vulnerabilities data for the target type from the lethality database 24. Based on the various vulnerabilities, and the calculated position between the weapon 12 and the target 22, the munitions endgame geometry for optimal lethality system 10 calculates the optimal endgame that is achievable under the conditions in order to achieve the highest probability of kill for the desired type of kill. This information is, cued to the guidance system 16 in order to deliver the weapon to a desired aim point with respect to the target 22 as well as to the fuze system 18 in order to fuze the weapon 12 appropriately upon arrival at the aim point. The aim point and fuze point are not necessarily the same point in space. The aim point is a point in space whereat the weapon 12 is traveling toward in order to achieve the highest possible probability of kill of the target 12. The fuze point is a point in space along the weapon's travel toward the aim point whereat the warhead of the weapon 12 is detonated in order to achieve the highest probability of kill. If the weapon's warhead is an aimable directional warhead, which is an emerging type of warhead that can dynamically altered and focused, the munitions endgame geometry for optimal lethality system 10 also cues the fuze system 18 to appropriately alter and focus the warhead as needed to achieve an optimal kill probability. The sensor system 16 continually monitors the target as well as the position of the weapon 12, which information is passed to the munitions endgame geometry for optimal lethality system 10 in order to continually update the endgame geometry (position, orientation, and velocity at fuze) that is achievable based upon the changed encounter geometry.

If the munitions endgame geometry for optimal lethality system 10 determines that encounter geometry of the weapon is such that the only available endpoint geometries will have probabilities of kill of the target that are relative low, the munitions endgame geometry for optimal lethality system 10 attempts to seek out alternate targets 22 that can be encountered and calculates the available probabilities of kill that can be achieved, and if necessary, alters the weapon to engage the new target.

While the invention has been particularly shown and described with reference to an embodiment thereof, it will be appreciated by those skilled in the art that various changes in form and detail may be made without departing from the spirit and scope of the invention.

We claim:

1. A control system for controlling a weapon, the weapon comprising a body having flight controls, a guidance system, a sensor system, and a fuze system for detonating a warhead the control system comprising:

a controller in communication with the guidance system, the sensor system, and the fuze system;

a lethality database having a plurality of entries such that each entry has a target entry, a plurality of vulnerabilities associated with the target entry, and a probability of kill quantity associated with each vulnerability; and wherein during a flight of the weapon, the sensor system identifies target as well as a first position coordinate set and communicates the target identified and the first position coordinate set to the controller such that the controller queries the lethality database in order to select a respective one target entry that corresponds with the target and retrieves the plurality of vulnerabilities and each associated probability of kill quantity, the controller determines which of respective one of the plurality of vulnerabilities having the highest probability of kill quantity can be attacked, calculates a optimal attack azimuth and elevation angle and a optimal burst height, and communicates the attack azimuth and elevation angle to the guidance system which then articulates the flight controls to achieve the attack azimuth and elevation angle and communicates the burst height to the fuze system in order to detonate at the burst height.

2. The control system as in claim 1 wherein the target entry includes a specific target type, a class of a target type, or a subclass of a target type.

3. The control system as in claim 1 wherein the control system calculates a way point for the weapon to fly to upon calculating the attack azimuth and elevation angle and such that upon reaching the way point, the weapon switches to a proportional navigation system.

4. The control system as in claim 1 wherein the sensor system identifies a second coordinate set subsequent to the identification of the first coordinate set, such that the controller calculates a new optimal attack azimuth and elevation angle which is communicated to the guidance system and a new optimal burst height which is communicated to the fuze system.

5. The control system as in claim 1 wherein the controller alters a geometry of the warhead.

6. The control system as in claim 1 wherein when the controller calculates that the respective one of the plurality of vulnerabilities that is selected has a probability of kill quantity that is below a predetermined threshold, the controller communicates to the sensor system to find another target.

7. The control system as in claim 1 in combination with the weapon.

8. The control system as in claim 7 wherein the target entry includes a specific target type, a class of a target type, or a subclass of a target type.

9. The control system as in claim 7 wherein the control system calculates a way point for the weapon to fly to upon calculating the attack azimuth and elevation angle and such that upon reaching the way point, the weapon switches to a proportional navigation system.

10. The control system as in claim 7 wherein the sensor system identifies a second coordinate set subsequent to the identification of the first coordinate set, such that the controller calculates a new optimal attack azimuth and elevation angle which is communicated to the guidance system and a new optimal burst height which is communicated to the fuze system.

11. The control system as in claim 7 wherein the controller alters a geometry of the warhead.

12. The control system as in claim 7 wherein when the controller calculates that the respective one of the plurality of vulnerabilities that is selected has a probability of kill quantity that is below a predetermined threshold, the controller communicates to the sensor system to find another target.

13. A method for controlling the weapon of claim 1 comprising the steps of:

providing a controller that is in communication with the guidance system, the sensor system, and the fuze system;

providing a lethality database and populating the lethality database with a plurality of entries such that each entry has a target entry, a plurality of vulnerabilities associated with the target entry, and a probability of kill quantity associated with each vulnerability;

launching the weapon;

having the sensor system identify target and a first position coordinate set and communicating the target identified and the first position coordinate set to the controller;

having the controller query the lethality database in order to select a target entry that corresponds with the target and retrieving the plurality of vulnerabilities and each associated probability of kill quantity;

having the controller determine which of respective one of the plurality of vulnerabilities having the highest probability of kill quantity can be attacked;

having the controller calculate an optimal attack azimuth and elevation angle based on the first coordinate set;

having the controller communicate the attack azimuth and elevation angle to the guidance system which then articulates the flight controls to achieve the attack azimuth and elevation angle;

having the controller calculate an optimal burst height based on the first coordinate set; and having the controller communicate the burst height to the fuze system in order to detonate at the first burst height.

14. The method as in claim 13 wherein the target entry includes a specific target type, a class of a target type, or a subclass of a target type.

15. The method as in claim 13 further comprising the steps of:

having the controller calculate a way point whereto the weapon flies on the way to the attack azimuth and elevation angle and the burst height; and switching the weapon to a proportional navigation system upon reaching the way point.

16. The method as in claim 13 further comprising the steps of:

having the sensor system identify a second coordinate set subsequent to the identification of the first coordinate set; and having the controller calculate a new optimal attack azimuth and elevation angle which is communicated to the guidance system and a new optimal burst height which is communicated to the fuze system.

17. The method as in claim 13 further comprising the step of having the controller alter a geometry of the warhead.

18. The method as in claim 13 further comprising the step of having the sensor system select a new target whenever the respective one of the plurality of vulnerabilities that is selected has a probability of kill quantity that is below a predetermined threshold.

* * * * *